US005090071A

United States Patent [19]

Bathrick et al.

[11] Patent Number: 5,090,071

[45] Date of Patent: Feb. 25, 1992

[54] TRANSPORTABLE AND FOLDABLE ARTICULATED BED

[75] Inventors: Leeland M. Bathrick, Crystal Lake; Glenn Brittain, McHenry, both of Ill.

[73] Assignee: C. E. B. Enterprises, Inc., Mundelein, Ill.

[21] Appl. No.: 610,097

[22] Filed: Nov. 7, 1990

[51] Int. Cl.[5] ..... A61G 7/00; A47C 19/12

[52] U.S. Cl. ..... 5/618; 5/174

[58] Field of Search ..... 5/66-69, 5/149, 151-153, 174, 202, 201, 162

[56] References Cited

U.S. PATENT DOCUMENTS

| | | | |
|---|---|---|---|
| 1,776,516 | 9/1930 | Lofman | 5/162 X |
| 1,791,540 | 2/1931 | Smith | 5/162 X |
| 2,357,242 | 8/1944 | Wahl | 5/66 |
| 3,245,092 | 4/1966 | Kreuz | 5/68 |
| 3,456,269 | 7/1969 | Goodman | 5/152 X |
| 3,739,406 | 6/1973 | Koetter | 5/149 |
| 3,965,500 | 6/1976 | Stein, Jr. | 5/66 X |
| 4,038,709 | 8/1977 | Kerwit | 5/66 X |
| 4,685,160 | 8/1987 | Rizzardo | 5/201 X |
| 4,970,737 | 11/1990 | Sagel | 5/63 X |

*Primary Examiner*—Michael F. Trettel

[57] ABSTRACT

A transportable and foldable articulated bed with a non-positively driven articulated mattress platform that reduces the risk of injury and permits the bed to be folded for transport without disconnecting platform drive systems. The mattress platform is articulated on a foldable frame consisting of a head section hinged to a foot section. A pair of retractable caster assemblies can be swiveled 270 degrees from a storage position mounted on the head frame section and connected to the foot frame section with both sections aligned to a position where it can also be connected to both sections when the bed is folded so it can be rolled about.

12 Claims, 6 Drawing Sheets

TRANSPORTABLE AND FOLDABLE ARTICULATED BED

BACKGROUND OF THE INVENTION

Articulated beds or bed frames for the home market have not heretofore achieved significant commercial success and such beds have for the most part been marketed as a hospital or nursing home product and with such objectives have been over designed and overly complicated and as a result have been too costly for the residential or home market for articulated beds.

Over the last several decades articulated chairs and sofas have achieved some commercial success in the residential market but only recently has such technology been adapted for the residential articulated bed marketplace.

A primary consideration in the design of articulated beds and components therefore in the residential market is ease of shipment because a container the size of an entire complete articulated bed assembly would not only be excessively large but too heavy for a single delivery person to bring into the home to install.

One attempt at solving this problem is illustrated in the Elliott, U.S. Pat. No. 4,381,571 which shows an articulated mattress spring that is adapted to fit on top of and rest on a separate simple rectangular bed frame. The Elliott power drive module or mattress frame includes large stationary "L" shaped side sections with cross members to provide support for axial oriented motor and screw assemblies that drive complicated four bar linkages at the four corners of the module that serve to raise and lower the head and leg sections of the mattress support. While Elliott suggests that these parts, numbering literally hundreds, may be disassembled for shipment, it is realistically not practical to have the purchaser reassemble this complex drive in his or her home.

A similar articulated bed is illustrated in the Neumann, U.S. Pat. No. 4,120,057 and it shows a power system for an articulated mattress support and, like the Elliott design, is adapted to fit into a bed frame. The problem with the Neumann device is that it requires a large rectangular frame the size of the bed frame itself so that no size reduction is practically possible in the Neumann system.

Furthermore, in the Neumann device the power module with drive motors, gearing and rocker shafts, requires that the rocker shafts be mounted in outboard bearings, i.e. bearings in the large rectangular frame described above and such outboard bearings denigrate the capability of shipping the power module in easily carried containers without requiring any significant reassembly at the purchaser's location.

Other articulated beds are illustrated in the Muir, U.S. Pat. No. 1,397,773 and the Szemplak, et al., U.S. Pat. No. 3,051,965. The patent to Muir also shows a device for adjusting the articulated bed. Double motor-type systems are shown in the Taylor, U.S. Pat. No. 2,500,742. Another standard articulated bed frame is illustrated in Hanning, et al., U.S. Pat. No. 3,921,230.

An important disadvantage in the above described articulated beds is that they do not readily fold up for transport without a significant amount of disassembly. Of course, folding beds with the head and foot sections articulated approximately at the mid-point of the bed frame so that the head and foot sections can meet one another and assume a generally planar vertical orientation for rolling on casters have been in the marketplace for many decades. However, this technology is not insofar as we are aware been applied to beds with articulated head and leg sections.

A foldable articulated bed would be desirable because of the manner of marketing and shipping articulated beds into the residential market. If the bed is foldable, it is far easier to transport and bring into the purchaser's home and set up with a minimum of assembly, and in many cases by the purchasers themselves.

Another disadvantage in prior articulated beds results from the motorized drive assemblies for the head and foot sections. Because articulation is frequently, if not usually, effected while the user is lying on the bed itself, a significant amount of torque must be provided by the head and foot platform drive units. As the head and foot platforms are lowered from their raised positions, there is a possibility of trapping fingers or arms between these descending platforms and the bed frame itself.

A further disadvantage in these prior articulated bed assemblies is that they must be carried into the purchaser's residence and because of their motorized configuration, they are quite heavy and frequently require two people to carry them into the purchaser's home as a unit without any disassembly.

It is a primary object of the present invention to ameliorate the problems noted above in prior art articulated bed assemblies.

SUMMARY OF THE PRESENT INVENTION

In accordance with the present invention a transportable articulated and foldable bed is provided with a pivotal head mattress platform and a pivotal leg platform both of which are driven by separate drive motor and screw assemblies mounted in the head section of a foldable generally rectangular frame.

The motor and screw drive assembly for the leg platform engages a pivot arm for the leg platform carried by the leg section of the bed frame. The screw drive for the leg platform however is not connected to the pivot arm and only engages it so that the head and foot sections of the frame can be folded up together without requiring any disconnection of the leg platform drive assembly which is carried by the frame head section from the leg platform pivot arm which is carried by the frame foot section.

This non-positive engagement of the motor drive to the leg platform pivot arm prevents the leg platform, as it is being lowered, from exerting any significant force on any human appendages that might inadvertently be between the leg platform and the bed frame or other links as the leg platform is being lowered.

The folding characteristic of the present articulated bed facilitates the shipping and transport of the bed into the residential marketplace, and in furtherance of this objective, retractable caster assemblies are provided according to the present invention that swivel from a storage position in the frame head section connecting both frame sections together 270 degrees to an active position when the bed frame is folded, underneath both of the adjacent head and foot sections. The bed can then be easily rolled about which is particularly useful when delivering the bed into the home of the ultimate purchaser.

Another important aspect of the present invention is that the entire articulated bed is adapted to be dropped into a standard residential two-side rail bed frame commonly found in most homes to support drop-in box spring and mattresses.

Other objects and advantages of the present invention will appear more clearly from the following detailed description.

DETAILED DESCRIPTION OF THE PREFERRED EMBODIMENTS

Figure 1:
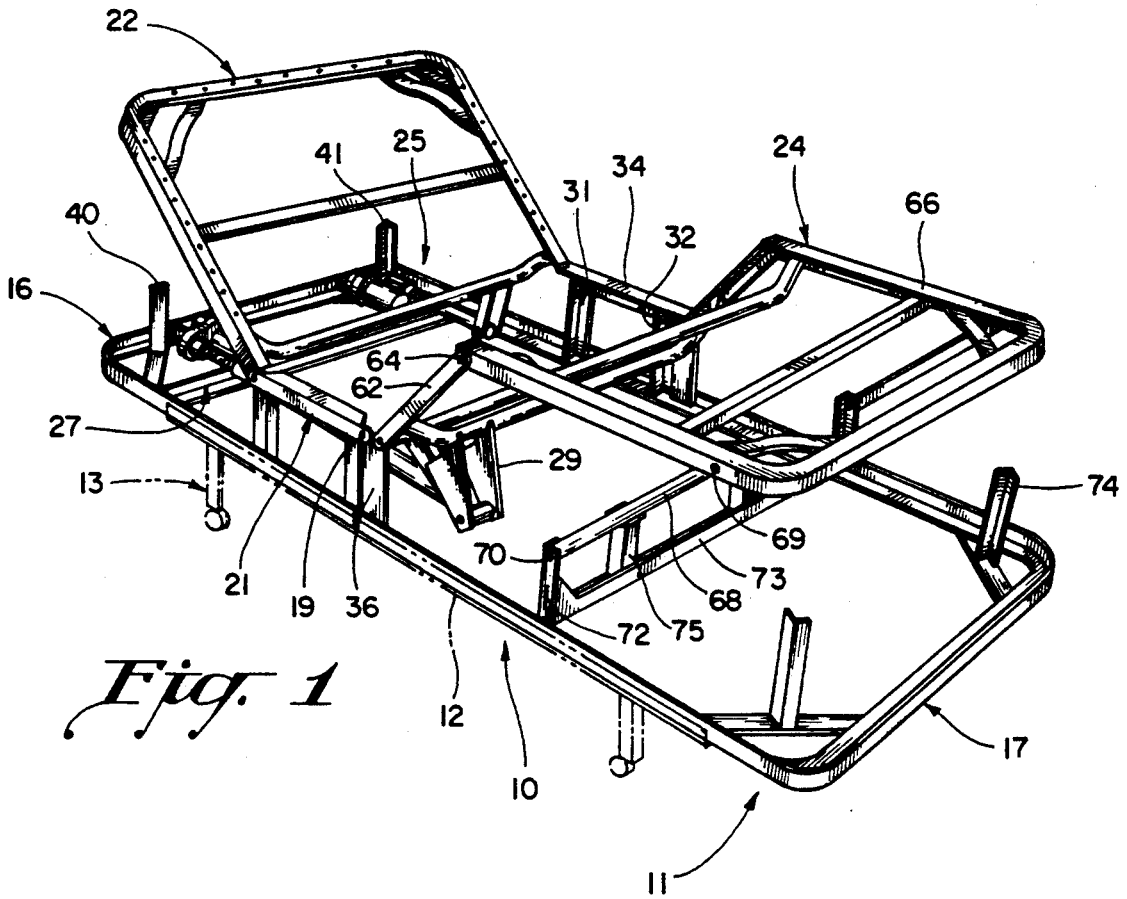
FIG. 1 is a perspective view of a foldable articulated bed assembly according to the present invention with the head and leg sections raised.

Referring to the drawings and particularly FIGS. 1 to 5, a foldable articulated bed assembly 10 is illustrated according to the present invention and is seen to generally include a rectangular frame 11 adapted to be placed on L-shaped side rails 12 of a standard residential bed frame 13 eliminating the need for a lower floor engaging frame in the present bed assembly.

Figure 4:
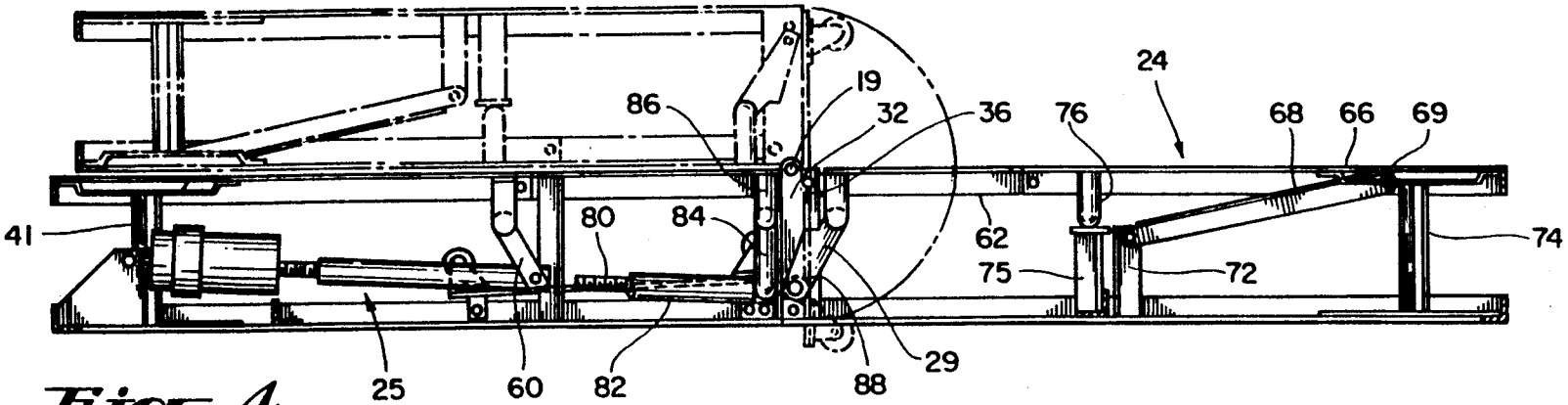
FIG. 4 is a side view in longitudinal section of the foldable articulated bed assembly illustrated in FIG. 1 with the platforms lowered and with the addition of a folded configuration of the bed with the leg section shown in dotted lines.
Figure 6:
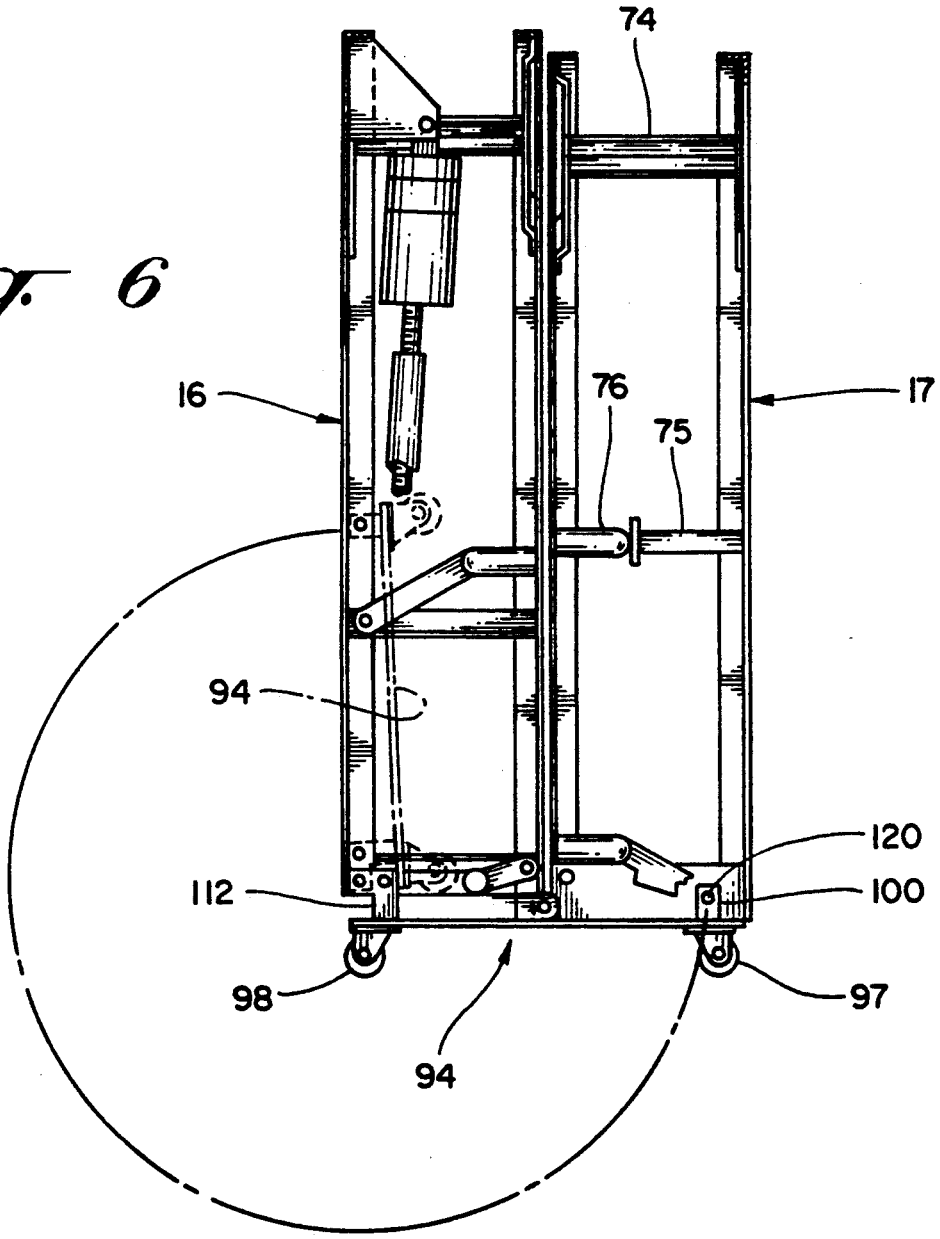
FIG. 6 is a longitudinal section of the present foldable articulated bed assembly in its folded configuration with one of the caster assemblies shown in dotted lines in its stored position and in full lines in its extended position.

The frame 11 is constructed of steel angle members and includes a head section 16 and a foot section 17 that can be folded onto one another as seen in FIGS. 4 and 6 about pivots 19.

The head frame section carries a fixed central platform 21 to which is articulated a mattress head platform 22. The foot frame section 17 carries an articulated mattress leg platform 24. Head platform 22 is driven by head motor and screw drive assembly 25 while the leg platform 24 is driven by a motor and screw drive assembly 27 that engages a leg platform pivot arm 29 to raise and lower leg platform 24.

The bed 10 illustrated in FIGS. 1 to 8 is constructed almost entirely of steel, most of which is angle iron. It should be understood that each of the platforms 21, 22 and 24 have closely spaced coil springs thereacross that have been deleted from the drawings for clarity.

The central fixed platform 22 includes a pair of vertical posts 31 and 32 welded to the head section side rails that are fixed to cross members 34 parallel to the frame head section 16. The foot section 17 has a pair of vertical posts 36 fixed thereto adjacent the central platform hinged at pivot 19 to the foot end of the central platform members 34 that enable the bed to be folded to its configuration shown in FIGS. 4 and 6.

Figure 3:
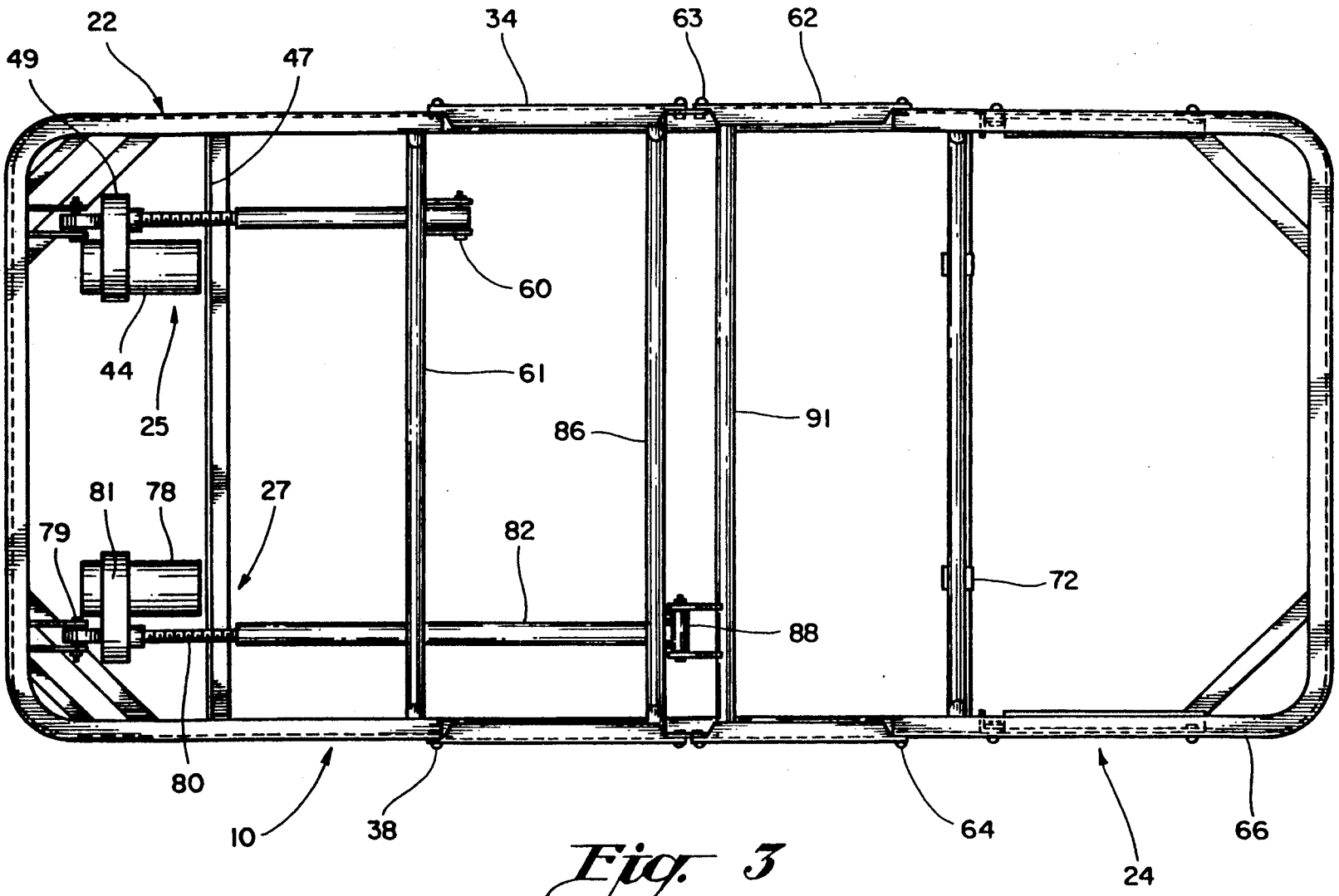
FIG. 3 is a top view of the foldable articulated bed assembly illustrated in FIG. 1 with the head and leg platforms lowered.

As seen more clearly in FIG. 3, the head platform is pivoted to the head end of the fixed central section by a pair of pivots 38, and a pair of vertical posts 40 and 41 seen in FIGS. 1 and 4 engage the head platform 22 as it is lowered and limits its downward movement to a position parallel to the head frame section 16.

As seen in FIGS. 1, 3 and 4, the head assembly motor and screw drive assembly 25 includes an electric motor 44 pivotally mounted at 45 to the end of the head frame section 16, that rotates a threaded screw 47 through a gear box 49. Screw 47 engages a threaded nut 51 in a drive tube 53 pivotally connected at 55 to a bifurcated pivot arm 58 fixed at its upper end to a cross rod 60 in turn fixed to the foot end of the head section 22.

Figure 2:
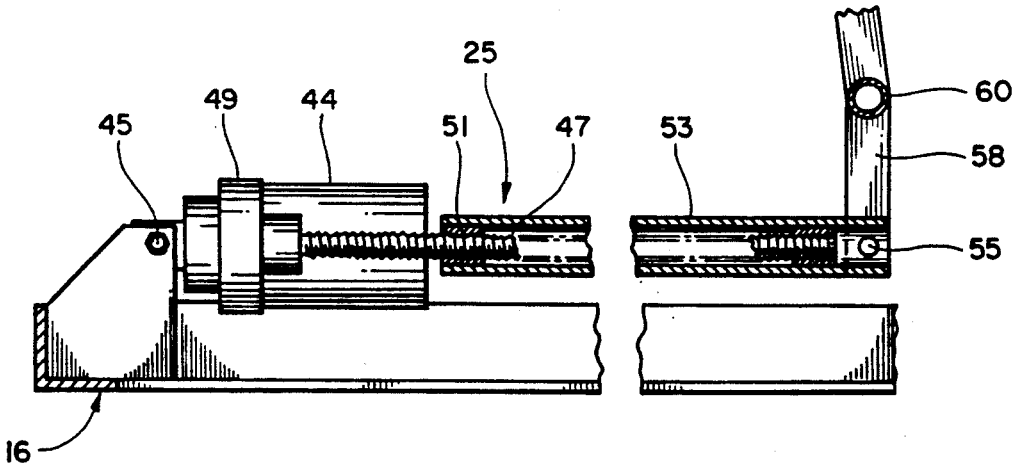
FIG. 2 is a fragmentary side view of the motorized drive for the head platform illustrated in FIG. 1.

As electric motor 44 rotates screw 47 in one direction to drive the tube 53 to the left in FIG. 2, pivoting arm 58 clockwise, the head platform 22 is raised, and conversely rotation of screw 47 in the opposite direction pivots arm 58 counter-clockwise lowering head platform 22.

The leg platform 24 includes a pair of parallel arms 62 pivotally mounted at 63 to the top of the support posts 36, both pivotally connected at their other ends at 64 to a U-shaped angle frame member 66 that forms part of the platform 24. Movement of the platform frame member 66 is controlled by a pair of pivot arms 68 pivotally connected at 69 near the foot end of the frame member 66 and pivoted at their other ends at 70 to a pair of short vertical support posts 72 welded to foot frame section 17.

The lowermost position of the leg platform 24 is illustrated clearly in FIG. 4, and this position is limited and defined by a pair of support posts 74 carried by the foot end of the foot frame section 17 that engage frame member 66, along with another pair of support posts 75 fixed to cross member 73 that engage downward projections 76 fixed to the foot platform frame member 66 as the leg platform 24 is lowered. Posts 74 and 75 engage frame member 66 when it is parallel to the foot frame section 17.

Figure 7:
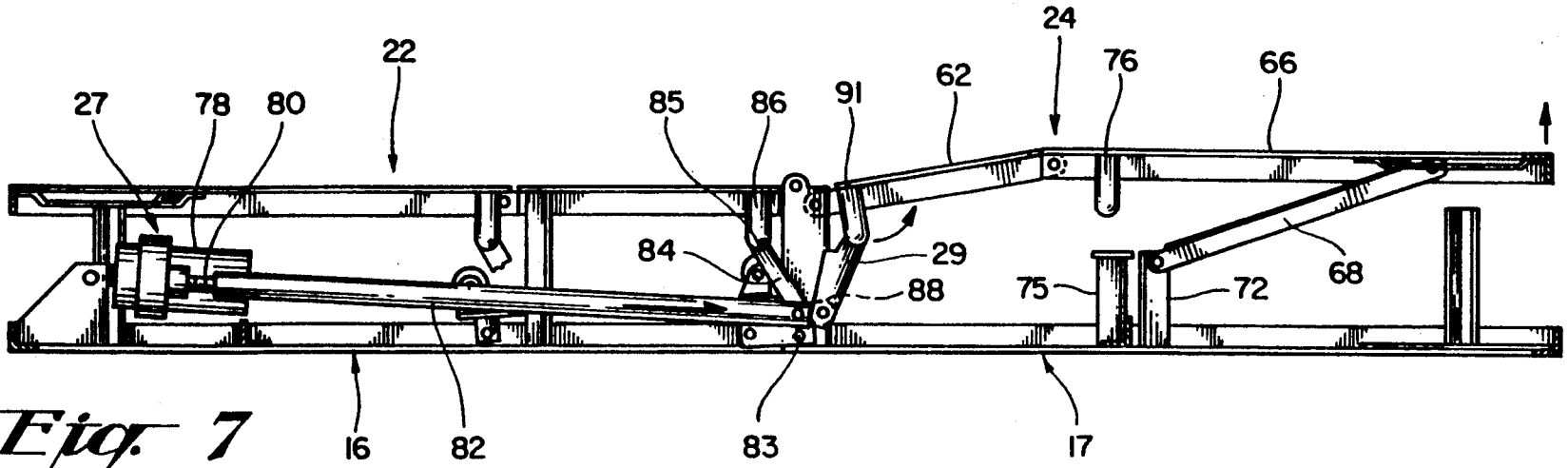
FIG. 7 is a longitudinal section illustrating the leg platform drive with the leg platform partly elevated.

The motor and screw drive assembly 27 for the leg platform 24 is shown more clearly in FIGS. 3 and 7 and is seen to include an electric drive motor 78 pivotally mounted at 79 to the head frame section 16, and it reversely drives a rotary screw 80 through a gear box 81. Threaded screw 80 engages drive tube 82, pivoted at its foot end at pivot 83 to a pivot arm 84 pivotally connected at its upper end 85 to central platform cross member 86.

The end of the tube 82 engages but is not connected to a nylon roller 88 on the lower end of bifurcated arm 29 fixedly connected at its upper end to cross member 91 in turn fixed at its ends to arms 62 of the leg platform 24.

As seen in FIG. 4, when the motor and screw drive assembly 27 is fully retracted as shown, and the leg platform 24 is completely lowered, the end of the screw drive tube 82 is slightly spaced from roller 88.

As screw 80 rotates to extend tube 82, it moves from its FIG. 4 position into engagement with roller 88 pivoting arm 29 counterclockwise in turn pivoting leg platform arms 66 upwardly also in a counterclockwise direction drawing platform member 66 upwardly as seen in FIG. 7, but still generally parallel to the frame section 17 and this movement continues until the leg platform reaches its maximum elevated position as illustrated in FIG. 1. Motor and drive assemblies 25 and 27 are provided with suitable limit switches to define the extreme upward positions of the head and leg platforms illustrated in FIG. 1.

As the leg platform drive tube 82 is retracted from the FIG. 1 position, the weight of the leg platform 24 maintains roller 88 in engagement with the end of the drive tube 82 even though there is no connection between the two. This non-positive drive prevents the leg platform 24 from exerting any significant force other than its own weight on any human appendages that may inadvertently be between the leg platform and the arms 68 or between the leg platform and any of the frame members.

Figure 5:
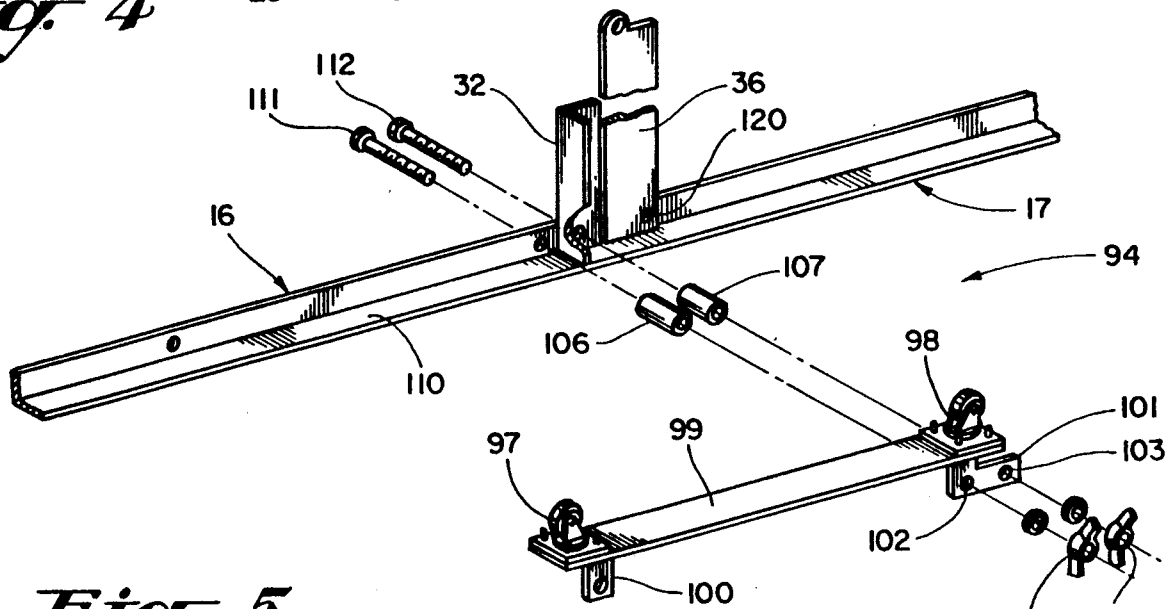
FIG. 5 is an exploded perspective of one of the caster assemblies illustrated in FIG. 4 in full lines in its stored position and in dotted lines in its extended position.
Figure 8:
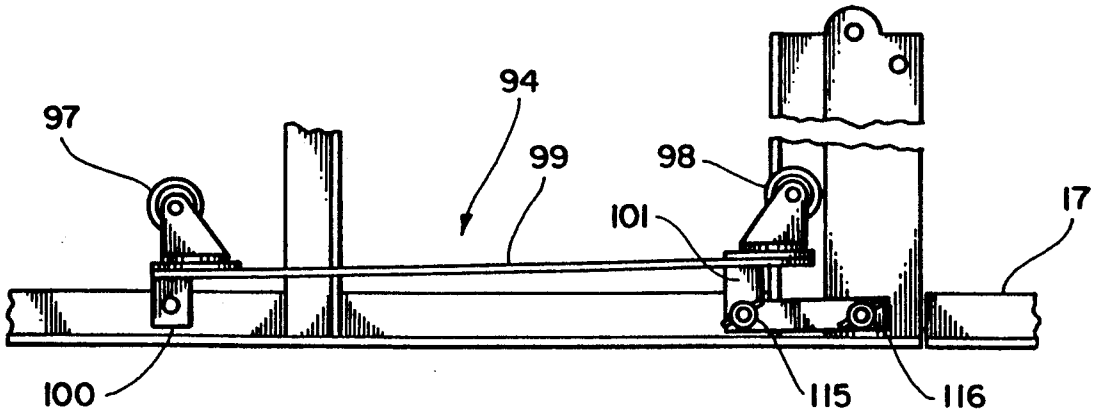
FIG. 8 is a fragmentary side view of one of the caster assemblies.

A retractable caster assembly 94 illustrated most clearly in FIGS. 5, 6 and 8 is provided on each side of the head frame section 16 mounted in retracted positions just behind center section support posts 32. The caster assemblies 94 are swivelable from retracted positions illustrated in FIG. 8 to their active positions illustrated in FIG. 6 when the frame sections 16 and 17 are in their folded positions illustrated in FIG. 6. In the retracted positions, the caster assemblies lock the head section 16 to the foot section 17.

Viewing FIGS. 5 and 8, each of the caster assemblies 94 includes a flat metal frame 99 having swivel caster assemblies 97 and 98 mounted on each end thereof. Frame 94 has a first apertured mounting flange 100 at one end and a second L-shaped apertured coplanar flange 101 at the other end having holes 102 and 103 therein.

Because frame 16 has an L-shaped configuration as does post 32, the caster assemblies have stand-off bushings 105, 106 and 107 that with threaded fasteners 108, 111 and 112 position the caster assemblies just inside lower frame portion 110. Bushings 105 and 106 are welded to frame 16 around the holes therein and bushing 107 is welded around hole 120 in post 36 of the foot section 17. Each of the fasteners 108, 111 and 112 receives wing nuts 114, 115 and 116 that enable the caster assemblies to be loosened and freed for swiveling movement from the dotted line position illustrated in FIG. 6 and the position shown in FIG. 8.

When it is desired to extend the caster assemblies 94, fasteners 108 and 112 are removed and fastener 111 is slightly loosened to define the pivot for the swiveling movement. The caster assemblies are then pivoted 270 degrees from the dotted line position illustrated in FIG. 6 to the full line position where the aperture in projection flange 100 lines up with the aperture 120 in the foot frame 17(also see FIG. 8) previously holding fastener 112. Fastener 108 is then inserted through the aperture in projection 100 and foot frame aperture 120 and a wing nut attached to connect the caster assemblies in their extended position and wing nut 115 on fastener 111 is retightened so that the caster assemblies are then solidly mounted to both frame sections. The bed is then lifted to a vertical position supported on the casters where it can be rolled easily.

It should be understood that modifications are within the scope of the present invention. For example, while the pivot 19 provides a convenient way for the frame sections to be folded together, it is also possible that the head and foot frame sections could be completely disconnected and then laid one upon the other, and it should be understood that further modifications are also within the scope of the present invention.

Figure 9:
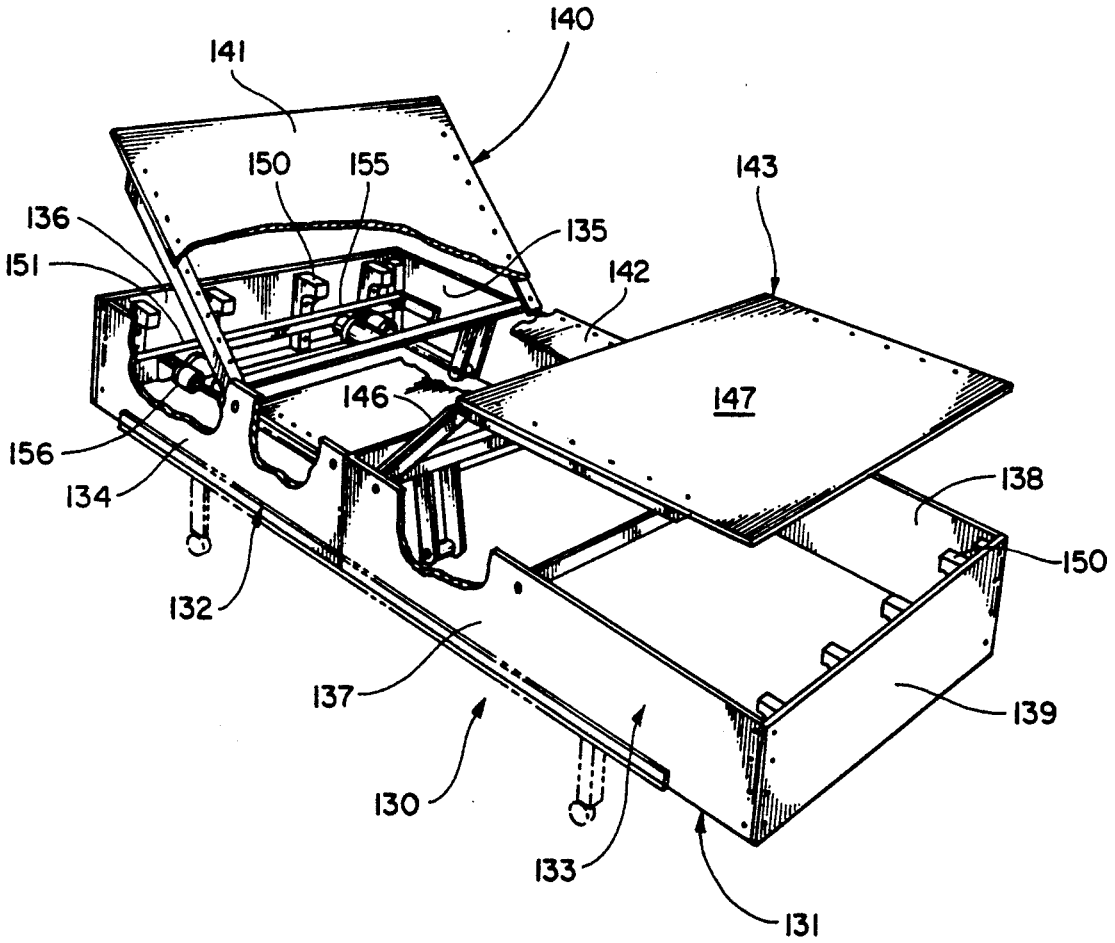
FIG. 9 is a partly fragmentary perspective view similar to FIG. 1 of another embodiment of the present invention having a wood frame.

For example, as illustrated in FIG. 9 where another embodiment of the present invention is illustrated, an articulated bed assembly 130 is provided that is functionally identical to the metal frame bed described above.

Bed assembly 130 includes a rectangular wooden frame 131 as opposed to the metal frame described in the FIGS. 1 to 8 embodiment. Frame 131 includes a head section 132 and a foot section 133. Head section 132 includes side members 134 and 135 interconnected by cross member 136, while foot section 133 includes side members 137 and 138 interconnected by cross member 139. Head section 132 is hinged to the foot section 133 at about the same location as the bed 10 described above.

A mattress platform generally designated by the numeral 140 includes a pivotal head platform 141, a fixed central platform 142 and a leg platform 143 consisting of pivotal panels 146 and 147. Each of the platforms includes a metal frame having a wooden top member connected thereto. The lowermost position of the head platform 141 is defined by wooden stops 150 mounted on head frame member 136 and the lowermost position of the leg platform is defined by similar wooden stops 151 carried by the foot frame member 138. Head platform motor and screw drive assembly 155 and leg platform motor and screw drive assembly 156 are supported on a metal cross member 157 fixed at its ends on the head end of the side frame members 134 and 135. The interconnections between motor and drive assemblies 155 and 156 to the head platform 141 and the leg platform 143 are identical to that described above with respect to the FIGS. 1 to 8 embodiment.

We claim:

1. A transportable and foldable articulated bed, comprising: a frame, a head and back platform mounted on one end of the frame, a leg platform mounted on the other end of the frame, at least one of the platforms being pivotally mounted on the frame for upward movement therefrom, said frame being relatively movable approximately at its center defining head and leg sections that can be reoriented with respect to one another for transport and storage, and motor means mounted on one of the frame sections for activating the pivotally mounted platform carried by the other frame section through an extendable drive, said pivotally mounted section having a pivot arm engageable with but completely unconnected to the extendable drive so that the frame can be separated without disconnecting the extendable drive from the pivot arm.

2. A transportable and foldable articulated bed, comprising: a frame, a head and back platform mounted on one end of the frame, a leg platform mounted on the other end of the frame, at least one of the platforms being pivotally mounted on the frame for upward movement therefrom, said frame being relatively movable approximately at its center defining head and leg sections that can be reoriented with respect to one another for transport and storage, and motor means mounted on one of the frame sections for activating the pivotally mounted platform carried by the other frame section through an extendable drive, said pivotally mounted section having a pivot arm engageable with but completely unconnected to the extendable drive so that the frame can be separated without disconnecting the extendable drive from the pivot arm, the head and back platform being pivotally mounted to the frame head section and the leg platform is pivotally mounted on the frame leg section so the platforms are folded onto one another as the frame is folded, said motor means including a first motor carried by the frame head section connected to pivot the leg platform through the extendable drive, said pivot arm being connected to the leg platform.

3. A transportable and foldable articulated bed, comprising: a frame, a head and back platform mounted on one end of the frame, a leg platform mounted on the other end of the frame, at least one of the platforms being pivotally mounted on the frame for upward movement therefrom, said frame being relatively movable approximately at its center defining head and leg sections that can be reoriented with respect to one another for transport and storage, and motor means mounted on one of the frame sections for activating the pivotally mounted platform carried by the other frame section through an extendable drive, said pivotally mounted section having a pivot arm engageable with but completely unconnected to the extendable drive so that the frame can be separated without disconnecting the extendable drive from the pivot arm, and caster assemblies on one of the frame sections each movable from a first retracted position to a second extended position wherein the bed can be rolled in a folded configuration.

4. A transportable and foldable articulated bed, comprising: a frame, a head and back platform mounted on one end of the frame, a leg platform mounted on the other end of the frame, at least one of the platforms being pivotally mounted on the frame for upward movement therefrom, said frame being hinged approximately at its center defining head and leg sections that can be folded onto one another for transport and storage, and motor means mounted on one of the frame sections for activating the pivotally mounted platform carried by the other frame section through an extendable drive, said pivotally mounted platform having a pivot arm engageable with but not connected to the extendable drive so that the frame can be folded without disconnecting the extendable drive from the pivot arm, said head and back platform being pivotally mounted to the frame head section and the leg platform being pivotally mounted on the frame leg section so the platforms are folded onto one another as the frame is folded, said motor means including a first motor carried by the frame head section connected to pivot the leg platform through the extendable drive, said pivot arm being connected to the leg platform.

5. An articulated transportable bed, comprising: a frame having a head section separately connected to a leg section so the frame can be reoriented for transport or storage, a head platform pivotally mounted to the head frame section, a leg platform pivotally mounted to the leg frame section, a first motor carried by one of the frame sections for pivoting one of the platforms through a first extendable drive, and a second motor carried by one of the frame sections for pivoting the other platform through a second extendable drive, at least one of the motors being carried by the frame section opposite to the frame section that carries the one platform it pivots, said one platform having a pivot arm engageable with but completely unconnected to the extendable drive of the one motor so the frame can be separated without disconnecting the extendable drive from the pivot arm.

6. An articulated transportable bed as defined in claim 5, wherein the frame is generally rectangular.

7. An articulated transportable bed as defined in claim 5, wherein the first and second drives are each a rotary screw drive.

8. An articulated transportable bed, comprising: a frame having a head section separately connected to a leg section so the frame can be reoriented for transport or storage, a head platform pivotally mounted to the head frame section, a leg platform pivotally mounted to the leg frame section, a first motor carried by one of the frame sections for pivoting one of the platforms through a first extendable drive, and a second motor carried by one of the frame sections for pivoting the other platform through a second extendable drive, at least one of the motors being carried by the frame section opposite to the frame section that carries the one platform it pivots, said one platform having a pivot arm engageable with but completely unconnected to the extendable drive of the one motor so the frame can be separated without disconnecting the extendable drive from the pivot arm, and caster assemblies on the frame each movable from a first retracted position to a second extended position wherein the bed can be rolled in a folded configuration.

9. An articulated transportable bed, comprising: a generally rectangular frame having a head section separated from a leg section about at the frame midpoint, a head platform carried by the head section and a leg platform carried by the leg section, at least one of the platforms being pivotally mounted to its frame section, motor means carried by one of the frame sections for pivoting the platform through an extendable drive, and two caster assemblies carried by one of the frame sections movable from a first position within the one frame section to a second position projecting from the one section and connected to both frame sections for supporting the bed for rolling motion.

10. An articulated transportable bed as defined in claim 9, wherein the caster assemblies include means for connecting the assemblies to said one frame section in their first positions and means for connecting the assemblies to both the head and leg frame sections in their second positions to stabilize both sections.

11. An articulated transportable bed as defined in claim 9, wherein each of the caster assemblies includes an elongated frame having one caster at each end thereof, said frames being mounted upside down in the one frame section when horizontal and unfolded from the other frame section, said caster frames being pivotal 270 degrees from the first position to the second position transverse and under both frame sections with the frame sections folded upon one another.

12. An articulated transportable bed, comprising: a generally rectangular frame having a head section pivotally mounted to a leg section about at the frame midpoint so the head section and leg section can be folded one upon the other, a head platform carried by the head section and a leg platform carried by the leg section, at least one of the platforms being pivotally mounted to its frame section, motor means carried by one of the frame sections for pivoting the pivotal platform through an extendable drive, and two caster assemblies carried by one of the frame sections movable from a first position within the one frame section to a second position projecting from the one section for supporting the bed for rolling motion, said caster assemblies including means for connecting the assemblies to said one frame section in their first positions and means for connecting the assemblies to both the head and leg frame sections in their second positions to stabilize both sections, each of the caster assemblies including an elongated frame having one caster at each end thereof, said caster frames being mounted upside down in the first positions of the assemblies in the one frame section when that section is horizontal, said caster frames being pivotal 270 degrees from their first position to their second position under both frame sections with the frame sections folded one upon the other.

* * * * *